US008689991B2

(12) United States Patent
Langh

(10) Patent No.: US 8,689,991 B2
(45) Date of Patent: Apr. 8, 2014

(54) TRANSPORT CONTAINER

(75) Inventor: Hans Langh, Piikkio (FI)

(73) Assignee: Oy Langh Ship Ab, Piikkio (FI)

( * ) Notice: Subject to any disclaimer, the term of this patent is extended or adjusted under 35 U.S.C. 154(b) by 0 days.

(21) Appl. No.: 13/813,974

(22) PCT Filed: Aug. 3, 2011

(86) PCT No.: PCT/FI2011/050683
§ 371 (c)(1),
(2), (4) Date: Feb. 4, 2013

(87) PCT Pub. No.: WO2012/017133
PCT Pub. Date: Feb. 9, 2012

(65) Prior Publication Data

US 2013/0126390 A1 May 23, 2013

(30) Foreign Application Priority Data

Aug. 4, 2010 (FI) ..... 20105836

(51) Int. Cl.
*B65D 88/00* (2006.01)

(52) U.S. Cl.
USPC ..... 220/1.5; 220/812; 294/68.1; 294/68.2

(58) Field of Classification Search
USPC ..... 220/1.5, 908, 810, 848, 212, 262; 294/68.1, 68.2
See application file for complete search history.

(56) References Cited

U.S. PATENT DOCUMENTS

| | | | | |
|---|---|---|---|---|
| 3,481,503 | A | 12/1969 | Kloess et al. | |
| 3,750,826 | A | 8/1973 | Donath et al. | |
| 4,144,984 | A | 3/1979 | Saunders | |
| 4,177,933 | A * | 12/1979 | Lumpp | 220/801 |
| 5,193,700 | A | 3/1993 | Lyman | |
| 2006/0289550 | A1 * | 12/2006 | Guardigli | 220/810 |
| 2012/0211506 | A1 * | 8/2012 | Cerveny et al. | 220/836 |

FOREIGN PATENT DOCUMENTS

| | | |
|---|---|---|
| EP | 0 085 977 A1 | 8/1983 |
| EP | 1428766 | 6/2004 |
| GB | 1274300 | 5/1972 |
| GB | 1 299 090 A | 12/1972 |
| JP | 2002/234539 | 8/2002 |
| WO | 2008/107626 | 9/2008 |

OTHER PUBLICATIONS

Finnish Search Report, dated May 3, 2011, from corresponding Finnish application.
International Search Report dated Oct. 21, 2011, corresponding to PCT/FI2011/050683.

* cited by examiner

*Primary Examiner* — Anthony Stashick
*Assistant Examiner* — Raven Collins
(74) *Attorney, Agent, or Firm* — Young & Thompson

(57) ABSTRACT

A transport container (1) has walls (5) and a roof (6) arranged on the top edges thereof. The roof (6) is detachable from the top edges of the walls (5). Either an edge of the roof (6) or a top edge of a wall (5), or both, is provided with a bevelled surface (8*a*, 8*b*) against which a fork arm of a forklift truck may be supported, the bevelled surface (8*a*, 8*b*) being arranged to guide the fork arm of the forklift truck to the underside of the top surface of the roof (6) to allow the roof (6) to be lifted by the fork arm of the forklift truck.

19 Claims, 2 Drawing Sheets

TRANSPORT CONTAINER

BACKGROUND OF THE INVENTION

The invention relates to a transport container having walls and a roof arranged on the top edges thereof, the roof being detachable from the top edges of the walls.

Transport containers may be provided with a detachable roof. The detachable roof may be removed from the transport container for the duration of loading and unloading of goods. When the transport container roof has been lifted off, loading of goods into and unloading them from the container is simple and runs smoothly.

The top surface of the roof is typically provided with lifting loops to allow the roof to be lifted up. WO 2008/107626, for example, discloses a transport container with loops above the roof to allow the fork arms of a forklift truck, for example, to be inserted through the loops and thus the roof to be lifted off from the container with the forklift truck. Roof loops are typically turnable so as not to occupy space in the height direction of the container during transport. Therefore, before the roof is lifted with the forklift truck, the loop must be manually turned to an upright position for the fork arms of the forklift truck. Hence the removal of the roof requires a plural number of work phases and, on the other hand, working at a dangerous location on the transport container roof.

The transport container roof can also be lifted using a crane, as disclosed in publications U.S. Pat. No. 5,193,700, JP 2002 234 539 and WO 2009/198 459, for example. The use of a crane is quite laborious and slow. Moreover, in such cases it is often necessary to work on the roof, for example to fasten the lifting cables of the crane to the lifting loops on top of the roof.

BRIEF DESCRIPTION OF THE INVENTION

It is an object of the present invention to provide a new type of transport container.

The transport container of the invention is characterized in that either an edge of the roof or a top edge of a wall, or both, is provided with a bevelled surface against which a fork arm of a forklift truck may be supported, the bevelled surface being arranged to guide the fork arm of the forklift truck to the underside of the top surface of the roof to allow the roof to be lifted with the fork of the forklift truck.

The invention is based on the idea that the transport container has walls and a roof arranged on the top edges of the walls, the roof being detachable from the top edges of the walls. Either an edge of the roof or a top edge of a wall, or both, is provided with a bevelled surface against which a fork arm of a forklift truck may be supported, the bevelled surface being arranged to guide the fork arm of the forklift truck to the underside of the top surface of the roof to allow the roof to be lifted with the fork of the forklift truck. This allows a single person operating the forklift truck to lift the roof from the container. Hence the roof is easily and smoothly lifted from the container in a relatively short period of time. Further, the removal of the roof is safe in all respects, because there is no need to carry out manual measures on top of the roof, for example.

BRIEF DESCRIPTION OF THE FIGURES

The invention will be described in greater detail in the attached drawings, in which.

In the figures, some embodiments of the invention are shown simplified for the sake of clarity. Similar parts are marked with the same reference numerals in the figures.

DETAILED DESCRIPTION OF THE INVENTION

Figure 1:
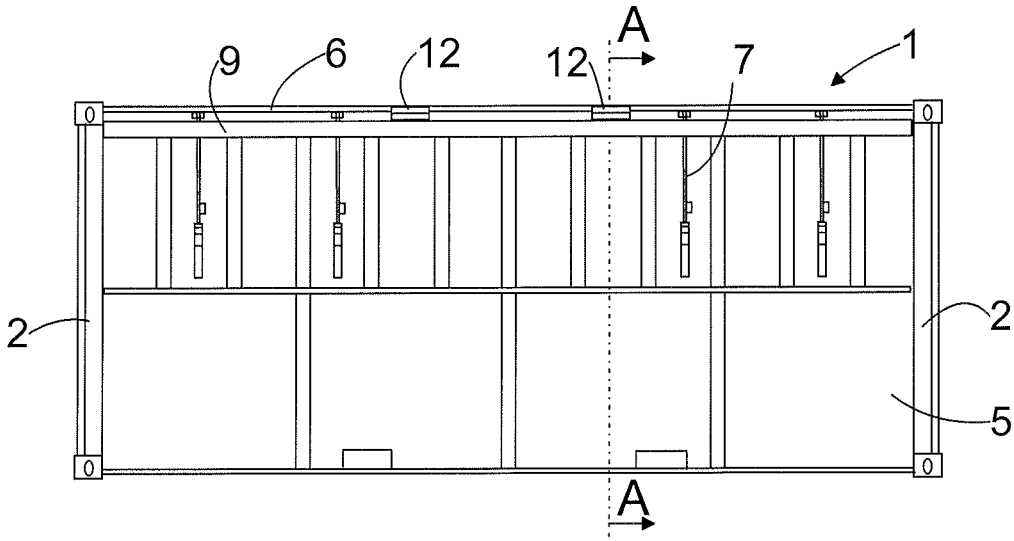
FIG. 1 is a schematic side view of a transport container.
Figure 2:
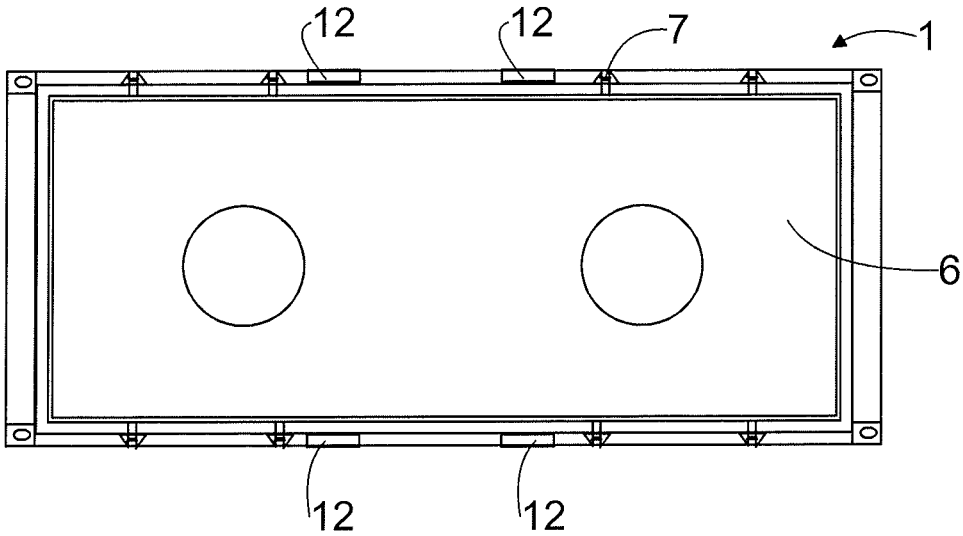
FIG. 2 is a schematic top view of the transport container of FIG. 1.

FIG. 1 shows a transport container 1 having a length of 20 feet, that is, approximately 6.1 meters, which corresponds to the length of a standard container. The width of the transport container 1 is 8 feet, that is, approximately 2.4 m, which corresponds to the width of a standard container. The height of the corner posts 2 and, thus, the height of the entire transport container 1 is approximately 2.59 meters.

Owing to the corner posts 2, a second container may be placed on top of the transport container 1. The corner post pairs at each end are joined together at their top ends with horizontal supports. One end of the transport container 1, for example, may be provided with a door. At the door 4, there may be locking latches or some other suitable means known per se for locking the door.

Both ends of the corner posts 2 are provided with fastening members for fastening members that are arrangeable on top of them at the corners. The containers lock into the fastening members with standard-type fastening arrangements, so the structure of the fastening arrangement is not described in more detail.

The transport container 1 is fastened with a fastening arrangement to a cover below it. The fastening arrangement may comprise a fastening means, for example, that fastens to the bottom corner of the transport container 1 and may be locked to the base, in which case it is a locking means. The mounting base may be e.g. a tween-deck of a ship or the bottom of a ship's cargo space or the deck of a ship's cargo space or some other deck or support base of a vehicle. The fastening arrangement structure will not be described in more detail in this context, because a fastening arrangement is used that is known and commonly used for fastening conventional containers to a ship deck, for example. All corners of the transport container 1 have a fastening means known to be used in containers. The fastening means is part of said fastening arrangement. The fastening means may also be used to connect together transport containers 1 placed on top of each other.

Figure 3:
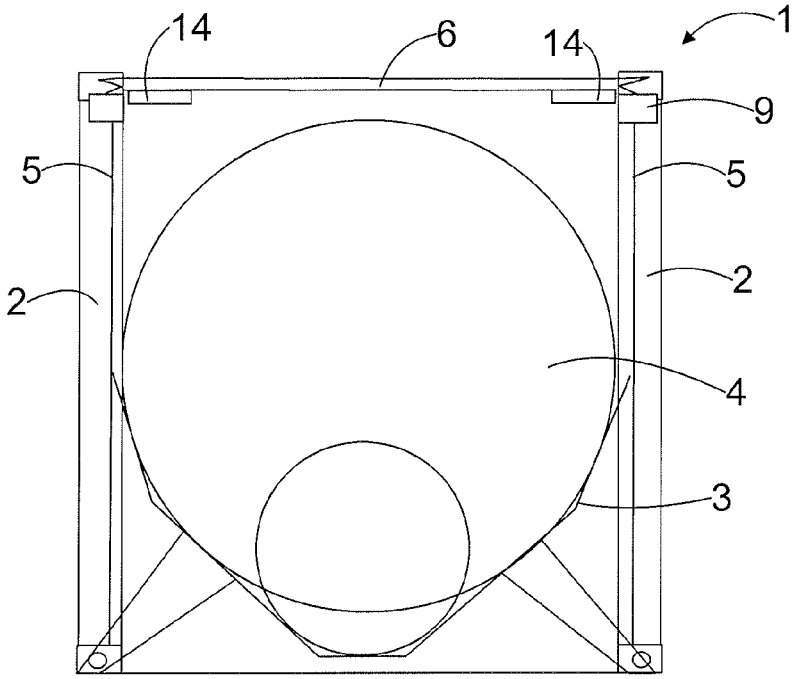
FIG. 3 is a schematic sectional view of the transport container of FIG. 1 along line A-A of FIG. 1.

According to the embodiment of FIG. 3, the transport container 1 may comprise a trough 3 for coils 4. In other words, the transport container 1 in question is a transport frame for transporting coils. In this context, coils refer especially to heavy steel coils that are formed of coiled steel plates. The weight of a coil is typically 10 to 25 tons, but it may be even heavier than this.

In addition to or instead of coils 4, the transport container 1 may be used for carrying other goods or material. The goods may consist of individual objects, bulk goods or bulk material. If the transport container 1 is not used for transporting coils 4 at all, a trough 3 and the associated support structures inside the transport container 1 are naturally not needed.

The transport container 1 has walls 5. On the top edges of the walls 5 there is provided a roof 6. The walls 5 and the roof 6 are solid and integral in such a manner that they render the transport container 1 totally closed or sealed, thus allowing the transport container 1 to be used for transport also in spaces subject to weather or other environmental impacts, for instance. Therefore, the transport container 1 may be used on top of a cargo deck or on other weather deck or in an open cargo space, for example. Naturally, the transport container 1 may also be utilised in an enclosed cargo space protected from weather or tween-deck or in some other protected space.

The roof 6 is detachable from the top edges of the walls 5. Thus, by detaching the roof 6, the transport container 1 can easily and simply be loaded and unloaded. The roof 6 is fastened in place with fastening latches 7 or by using some other fastening arrangement suitable for the purpose. The fastening latches 7 are preferably usable from the floor level, that is, when standing level with the bottom edge of the transport container 1, as shown in FIG. 1.

Figure 4:
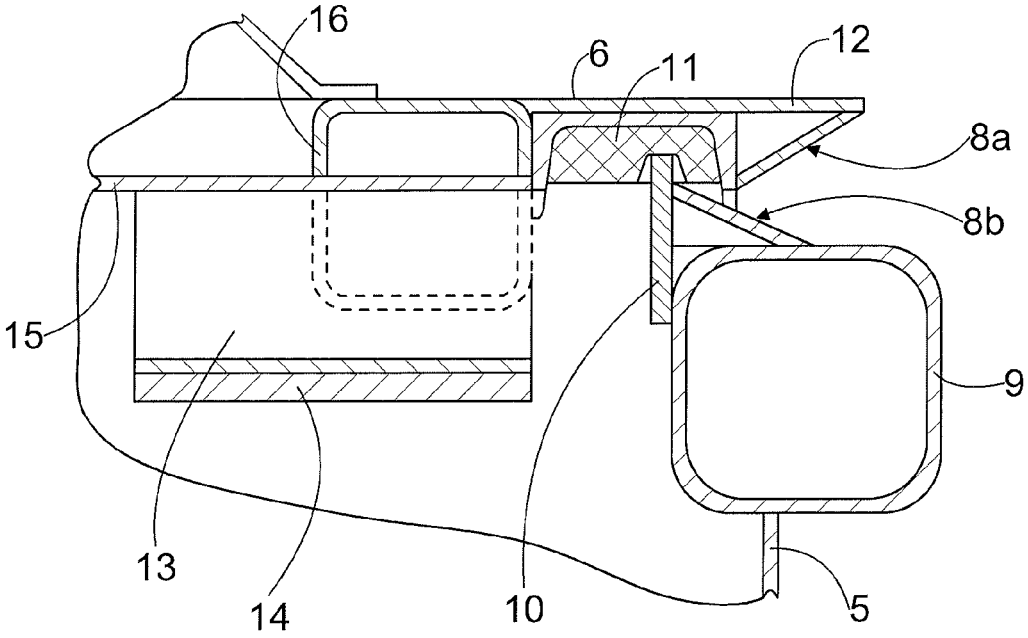
FIG. 4 is a schematic view of a detail of FIG. 3 showing a connection point of the top edge of a wall and the roof of the transport container.

As shown in FIG. 4 in particular, the edge of the roof 6 is provided with a bevelled surface 8*a* and, correspondingly, the top edge of the walls 5 is provided with a bevelled surface 8*b*. A fork arm of a forklift truck may be supported against the bevelled surfaces 8*a* and 8*b*. When the fork arm of the forklift truck is pushed in a lateral direction, the bevelled surfaces 8*a* and 8*b* guide the fork arm of the forklift truck to the underside of the top surface of the roof 6 to allow the roof 6 to be lifted with the fork arm of the forklift truck.

The top edge of the wall 5 is provided with a top beam 9 in the longitudinal direction of the container 1. To the side of the top beam 9 is attached a plate 10 made of steel, for example. In association with the roof 6, in turn, there is provided a sealing 11. The sealing 11 presses against the steel plate 10 and therefore the connecting point between the roof 6 and the wall 5 is tight.

The bevelled surface 8*b* at the top edge of the wall 5 may be formed by a wedge-shaped piece, for example. On the other hand, the bevelled surface 8*b* may be formed for example by welding the steel plate to the top beam 9 and the plate 10 in an inclined position.

The bevelled surface 8*a* of the roof 6 may be formed by a wedge piece 12 protruding from the rest of the roof edge. The wedge piece 12 may be welded, for example, to the edge of the roof 6.

The fork arm of the forklift truck is thus pushed towards the bevelled surfaces 8*a* and 8*b*. When the tip of the fork arm is under the bevelled surface 8*a*, the edge of the roof 6 is slightly lifted and the arm is pushed at the same time further under the roof. The bevelled surface 8*a* guides the arm so that it does not damage the sealing 11. The fork is thus lifted up slightly before its arm hits the steel plate 10.

When the fork arms have sufficiently extended under the roof, the tip of the arms may be lifted and raised a little to also lift up the opposite side of the roof 5 out of the structures of the transport container 1. When the roof 5 is entirely removed from inside the structures of the transport container 1, it may be moved aside for the duration of the loading of the transport container 1. The roof 5 is put back in place in reverse order to its removal. The roof 5 is brought above the transport container 1 in alignment with the transport container 1 and lowered carefully close to the top structures of the transport container 1. The roof 5 is positioned inside the wall structures of the transport container 1, the edge facing the truck being lowered first. When the roof 5 is in the proper position, the truck forks are withdrawn.

On the underside of the top surface of the roof 5 there is preferably provided a cavity 13, into which a fork arm of the forklift truck is guided. Because of the cavity 13 the roof 5 is firmly and safely supported by the fork arm of the forklift truck. The cavity 13 may be formed by welding a U beam 14, for example, by its upper arms to the under surface 15 of the roof 5. On the other hand, if the edge of the roof 5 is provided with a suitable longitudinal beam 16, for example, the cavity 13 may be formed by making holes to the beam 16 for the fork arm of the forklift truck.

The cavity 13 is preferably formed of two or more consecutive parts, which are at a distance from one another. This allows the portion between the cavities 13 to be used as a cargo space. FIG. 3, for example, shows that the U beams 14 are arranged to the edge portions of the transport container, the free height available in the centre part of the transport container 1 thus being greater than that at the edges of the transport container 1. For example, when coils are transported, the lower free space at the edges of the transport container 1 does not in any way restrict transport capacity.

In some cases, features disclosed in this application may be used as such, irrespective of other features. On the other hand, when necessary, the features disclosed in this application may be combined in order to provide various combinations.

The drawings and the related description are only intended to illustrate the idea of the invention. The details of the invention may vary within the scope of the claims.

The invention claimed is:

1. A transport container, comprising:

walls and a roof arranged on the top edges of thereof, the roof being detachable from the top edges of the walls, either an edge of the roof or a top edge of a wall, or both, being provided with a bevelled surface, against which a fork arm of a forklift truck may be supported, the bevelled surface being arranged to guide the fork arm of the forklift truck to the underside of the top surface of the roof to allow the roof to be lifted up with the fork of the forklift truck, a top beam running in a longitudinal direction of the container at the top edge of the wall, and corner posts positioned at corners of the wall, wherein the corner posts defining a length and width of the transport container, and wherein the corner posts extend above top beam and above the bevelled surface.

2. A transport container as claimed in claim 1, wherein the bevelled surface is formed both to the edge of the roof and to the top edge of the wall.

3. A transport container as claimed in claim 1, wherein the bevelled surface is formed to the edge of the roof by a wedge part protruding from the rest of the roof edge.

4. A transport container as claimed in claim 2, wherein the bevelled surface is formed to the edge of the roof by a wedge part protruding from the rest of the roof edge.

5. A transport container as claimed in claim 1, wherein on the underside of the top surface of the roof there is a cavity into which the fork arm of the forklift truck may be arranged.

6. A transport container as claimed in claim 5, wherein the cavity is formed of two or more consecutive parts, which are arranged at a distance from one another.

7. A transport container, comprising:

a wall having a top edge;

a roof detachable from the top edge of the wall;

corner posts positioned at corners of the wall, the corner posts defining a length and width of the transport container;

a forklift truck arm support edge located at one of i) an outside top edge of the roof and ii) the top edge of the wall, the support edge having a bevelled surface that guides the fork arm to an underside of a top surface of the roof and that allows the roof to be lifted up with the fork of the forklift truck, wherein the corner posts extend above an uppermost surface of the support edge.

8. A transport container as claimed in claim 7, wherein the bevelled surface is located both at the top edge of the roof and the top edge of the wall with the respective bevelled surfaces define a V-shaped space therebetween, the V-shaped space facing out from the wall.

9. A transport container as claimed in claim 7, wherein the bevelled surface is formed to the edge of the roof by a wedge part protruding from the rest of the roof edge.

10. A transport container as claimed in claim 8, wherein the bevelled surface is formed to the edge of the roof by a wedge part protruding from the rest of the roof edge.

11. A transport container as claimed in claim 7, wherein, on the underside of the top surface of the roof there is a cavity into which the fork arm of the forklift truck may be arranged.

12. A transport container as claimed in claim 11, wherein the cavity is formed of two or more consecutive parts, which are arranged at a distance from one another.

13. A transport container as claimed in claim 7, wherein the length of the transport container is 20 feet and the width is 8 feet.

14. A pair of transport containers as claimed in claim 7, wherein, a first of the transport containers is located on top of a second of the transport containers, and the corner post pairs of each of said transport containers are joined together.

15. A pair of transport containers as claimed in claim 1, wherein, a first of the transport containers is located on top of a second of the transport containers, and the corner post pairs of each of said transport containers join together.

16. A transport container as claimed in claim 1, wherein the bevelled surface is located both at the top edge of the roof and the top edge of the wall with the respective bevelled surfaces define a V-shaped space therebetween, the V-shaped space facing out from the wall.

17. A transport container as claimed in claim 1, further comprising, interior to the wall, a coil trough configured for transporting coils having a weight in a range of 10 to 25 tons.

18. A transport container as claimed in claim 7, further comprising, interior to the wall, a coil trough configured for transporting coils having a weight in a range of 10 to 25 tons.

19. A transport container as claimed in claim 7, further comprising:

a top beam running in a longitudinal direction of the container at the top edge of the wall, wherein the corner posts extend above top beam and above the bevelled surface.

* * * * *